United States Patent [19]

LaLama et al.

[11] 4,328,956

[45] May 11, 1982

[54] TAPHOLE ASSEMBLY AND METHOD OF INSTALLATION

[75] Inventors: Samuel J. LaLama, Poland; Paul T. Fennema, Salem, both of Ohio

[73] Assignee: Kaiser Aluminum & Chemical Corporation, Oakland, Calif.

[21] Appl. No.: 219,623

[22] Filed: Dec. 24, 1980

[51] Int. Cl.[3] ..... C21B 7/06; C21B 9/06

[52] U.S. Cl. ..... 266/275; 266/243; 266/271

[58] Field of Search ..... 266/271–275, 266/236, 240

[56] References Cited

U.S. PATENT DOCUMENTS

| | | | |
|---|---|---|---|
| 3,201,225 | 8/1965 | Haynes | 266/271 |
| 3,295,845 | 1/1967 | Finn | 266/236 |
| 3,329,420 | 7/1967 | Finn | 266/236 |
| 3,398,945 | 8/1968 | Walpole | 266/272 |
| 3,416,779 | 12/1968 | Campbell | 266/243 |
| 3,416,779 | 12/1968 | Campbell | 266/243 |
| 3,554,523 | 12/1971 | Miller | 266/236 |
| 4,026,443 | 5/1977 | Meier | 266/271 |

FOREIGN PATENT DOCUMENTS

| | | | |
|---|---|---|---|
| 1485878 | 9/1977 | United Kingdom | 266/236 |

*Primary Examiner*—P. D. Rosenberg

*Attorney, Agent, or Firm*—Paul E. Calrow; Malcolm McQuarrie

[57] ABSTRACT

A taphole assembly comprises three refractory pieces: (1) a monolithic central block with a hole for the passage of molten metal and (2) upper and lower wedge supports for the central block. The purpose of the assembly is to position the taphole between parallel layers of lining brick with the metal conducting hole at an angle to the lining brick surfaces. The assembly is installed by supporting the central block on a counterweighted bar in position in the furnace, and constructing the furnace lining around the assembly.

6 Claims, 14 Drawing Figures

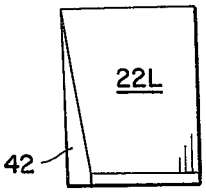
FIG. 6
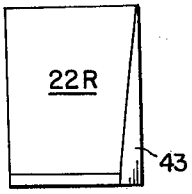
FIG. 7
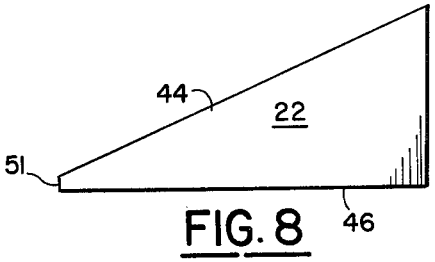
FIG. 8
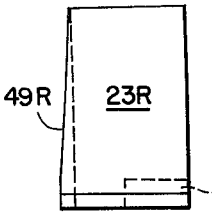
FIG. 9
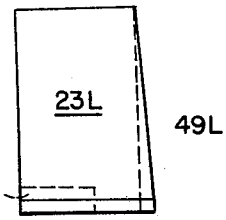
FIG. 10
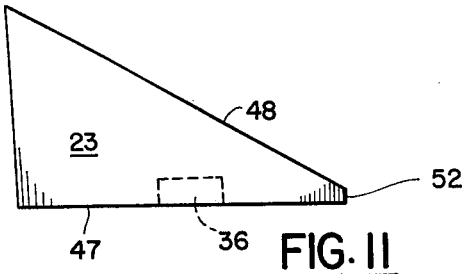
FIG. 11
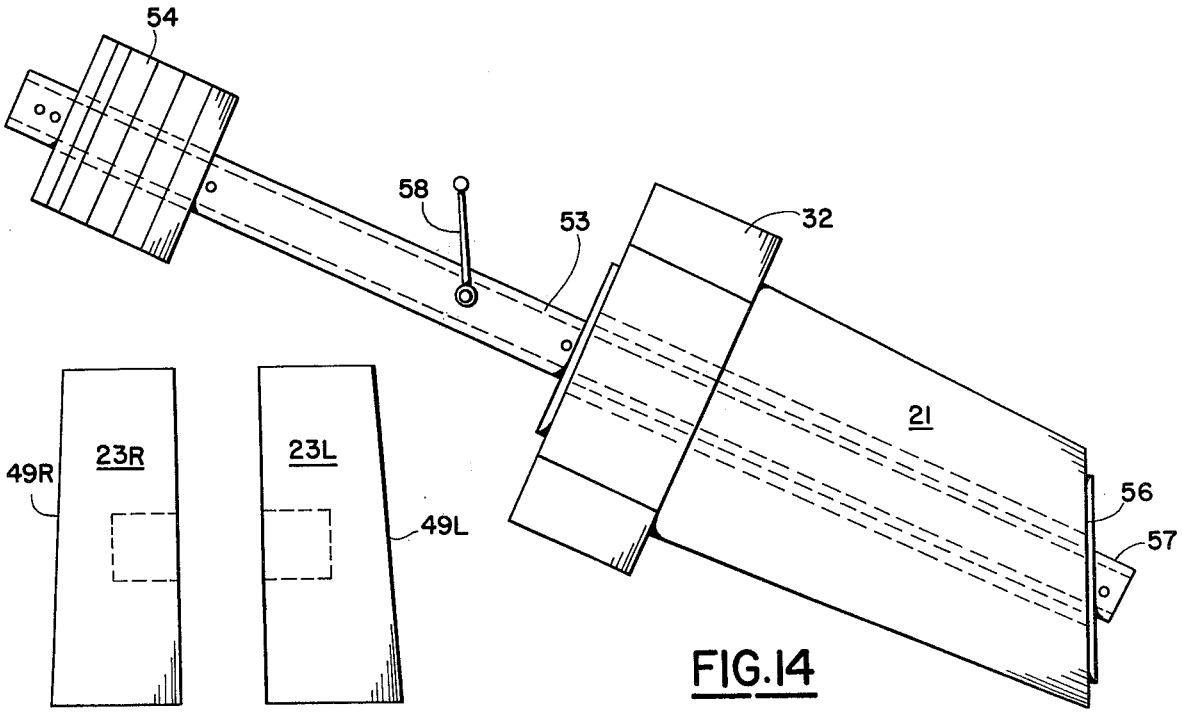
FIG. 14
FIG. 12
FIG. 13

TAPHOLE ASSEMBLY AND METHOD OF INSTALLATION

BACKGROUND OF THE INVENTION

This invention pertains to a taphole assembly and a method of installing it. The invention has particular use in steelmaking furnaces such as basic oxygen furnaces.

Tapholes are well-known; they are designed to conduct molten metal from inside a furnace where it has been melted or refined to another container, for example a ladle. They are also used in open-hearth furnaces, electric arc furnaces, and blast furnaces in the steel industry, as well as for pouring molten nonferrous metals. For example, U.S. Pat. No. 3,329,420 and U.S. Pat. No. 3,416,779 show tapholes in place in basic oxygen furnaces. In addition, U.S. Pat. No. 3,295,845, U.S. Pat. No. 3,554,523 and British Pat. No. 1,485,878 show the structure of such tapholes in greater detail.

Most of the tapholes shown in the above patents have joints in the molten metal passage itself; these joints offer points of attack on the refractory used to construct the taphole. The monolithic taphole shown in U.S. Pat. No. 3,416,779 is apparently set in a rammed or cast in situ section of the lining. The use of rammed or cast in situ material again offers a point of attack for the slag and molten metal on the refractory lining, rammed or cast in situ refractory generally being less resistant to attack by such materials than the same composition in brick form.

The taphole of the present invention is designed to overcome the foregoing problems, providing a monolithic metal carrying channel without joints in a structure which does not require that rammed or cast in situ material be exposed to molten slag and metal.

SUMMARY OF THE INVENTION

The taphole assembly of the present invention comprises (1) a monolithic central block having an upper face, a lower face, two opposing side faces, an inner end face and an outer end face, the two side faces converging toward the inner end face, said block having a passageway adapted to carry flowing molten metal and extending from the inner end face to the outer end face; (2) a bottom wedge block having a lower face, an upper face, an outer face, and two opposed side faces; and (3) a top wedge block having a lower face, an upper face, an inner face, and two opposed side faces; the configuration of both upper and lower wedge blocks being such that, when assembled with the upper face of the bottom block against the bottom face of the central block, and the lower face of the top block against the upper face of the central block, the lower face of the bottom wedge block is parallel to the upper face of the top wedge block, the side faces of each wedge block lying within the planes formed by extension of the side faces of the central block; the top and central blocks being keyed together to prevent relative movement parallel to their contacting faces.

BRIEF DESCRIPTION OF THE DRAWINGS

FIGS. 6 and 7 are end elevation views of the left and right pieces, respectively, used to form the lower wedge piece;

FIG. 8 is a side elevation of the preceding pieces;

FIGS. 9 and 10 are end elevation views of the right and left pieces, respectively, used to form the upper wedge block;

FIG. 11 is a side elevation of the preceding pieces;

FIGS. 12 and 13 are top plan views of the pieces of FIGS. 9 and 10; and FIG. 14 shows a balance bar used to install the taphole in a furnace.

DETAILED DESCRIPTION

It will be understood that the embodiment of the invention described below incorporates many preferred features of the invention, the scope of which is defined in the claims.

Figure 1:
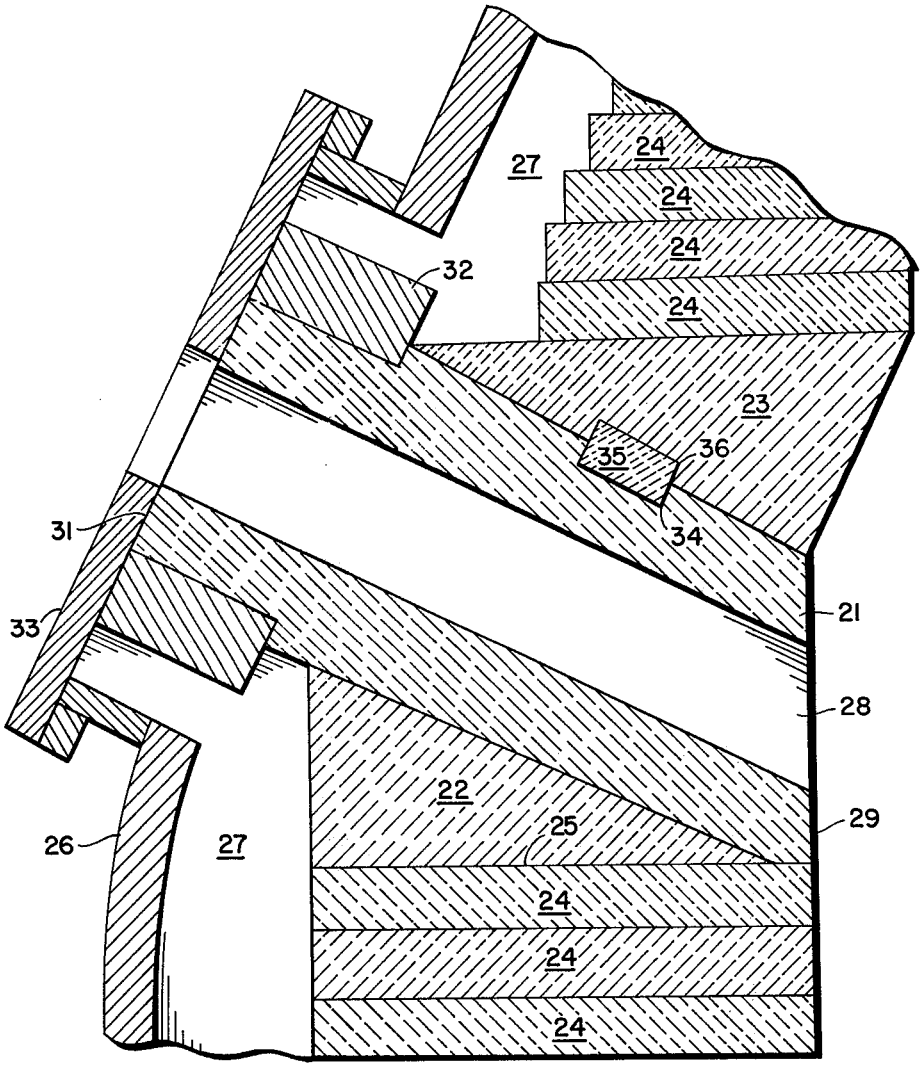
FIG. 1 is a vertical cross section of the assembly of this invention in place in a furnace.

As shown in FIG. 1, the assembly of this invention includes a central block 21, a lower wedge block 22 in supporting relationship to central block 21, and upper wedge block 23 providing a flat surface at the top of the assembly for the placement of further brick 24 in the furnace lining. As can be seen from the drawing, blocks 22 and 23 both extend from inner face 29 of block 21 a major portion of the distance along the length of block 21.

The assembly is shown in place in a basic oxygen furnace (BOF) with an outer steel shell 26 and safety lining 27, for example of refractory brick, between shell 26 and refractory brick 24 of the working lining. Central block 21 contains passage 28 extending from its inner end face 29 to outer end face 31, and designed for conducting molten metal when the vessel is tipped to tap the molten charge.

Figure 2:
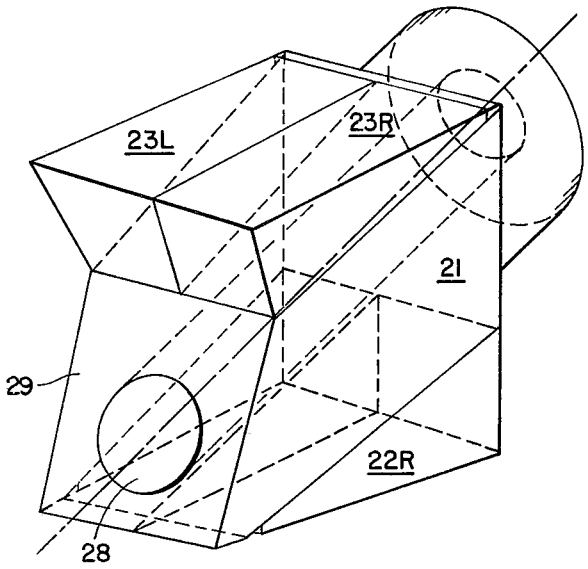
FIG. 2 is a perspective view of the assembly.

As shown more clearly in FIG. 2, block 21 preferably has its inner portion of generally rectangular shape and its outer portion of circular shape. When assembled in the furnace, a circle of wedge brick 32 is placed about this circular outer end of block 21. The ring of arch brick 32 can be laid about the outer end of block 21 during construction of the lining or they may be assembled about block 21 and held in place, for example by metal strapping, prior to placing the assembly in position in the furnace. As shown in FIG. 1, after installation the taphole assembly is retained in place by retainer plate 33 attached to shell 26 after total assembly is completed.

Upper wedge block 23 is keyed into central block 21 to prevent block 23 from sliding out of position, a simple 9" straight refractory brick 35 placed in complementary recesses 34 and 36 in blocks 21 and 23 being shown.

Figure 3:
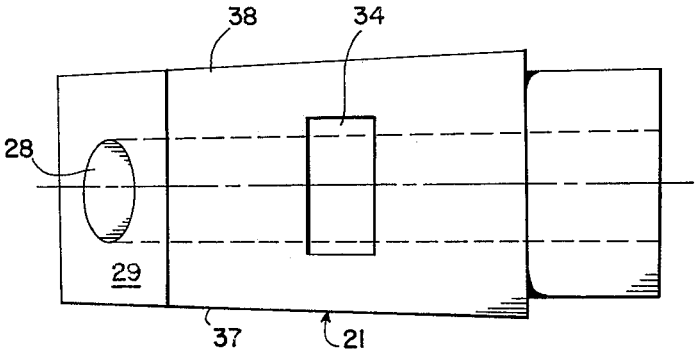
FIGS. 3, 4 and 5 are top plan, side elevation, and end elevation views, respectively, of the central block.

It will be appreciated that the BOF vessel is round and, in order to turn this circle, refractory brick 24 are of tapered shape in the horizontal plane. They can be, for example, key, wedge, circle, or the like brick. Correspondingly, the assembly of the present invention must also be of tapered shape so as to continuously turn the circle of refractory within the furnace. Accordingly, particularly as shown in FIG. 3, central block 21 has side faces 37 and 38 which converge toward face 29. It will be appreciated that the exact degree of this convergence or taper will be determined by the size of the furnace, and consequently the size of the circle to be turned by the refractories in it. In other words, the precise dimensions and configuration of the blocks used in the taphole assembly of this invention will be dictated by the particular furnace in which it is to be used, as well as by the desired angle of passage 28.

Figure 4:
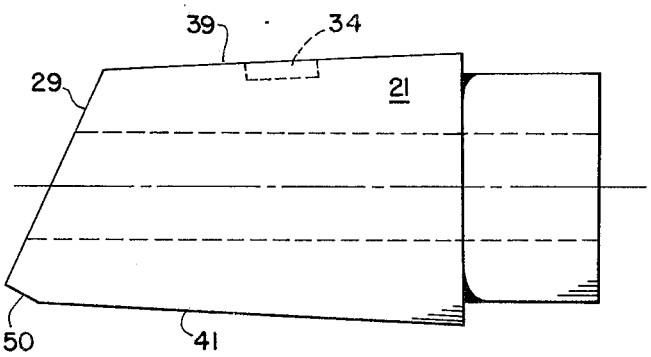
Figure 5:
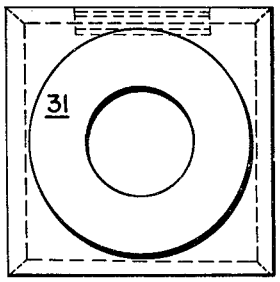

In addition, as shown in FIG. 4, upper face 39 and lower face 41 of central block 21 preferably also converge towards inner end face 29. This latter taper or convergence is not necessary to the structure, but is added assurance that block 21 will not slide into the furnace, particularly when it is tilted.

Monolithic block 21 is preferably made by vibration casting in a mold. While ramming could be used, it has been found that vibration casting gives a denser structure, and hence one which is more resistant to erosion and corrosion by molten metal and slag. The refractory composition used can be any desired composition which is compatible with the slag with which it comes in contact, as is well-known in this art.

While lower wedge block 22 can be made as a single piece, it is preferred that it be made in at least two pieces, 22L and 22R. This is because smaller refractory shapes are easier to form and are also easier to handle during installation. Obviously, block 22 could be made of three or even more pieces, if desired. Side faces 42 and 43 of block 22 converge towards the inner end, as already described for block 21. It will be evident that the upper face 44 of block 22 will be formed with such an angle so that when block 22 is assembled with block 21, and the assembly placed in the furnace, lower face 46 of block 22 will be parallel to upper face 25 of refractory lining brick 24. Generally, these faces 25 and 46 will be horizontal when the furnace is in its upright position, in the case of a BOF.

Similarly, upper wedge block 23 could be made as a single piece, but is preferably made in two or more pieces, pieces 23R and 23L of a pair which are mirror images of each other being shown in FIGS. 9 through 13. Note that in FIGS. 9 and 10, block 23 is looked at from the outside of the furnace inward when block 23 is in place, whereas FIGS. 6 and 7 look at block 22 from the inside of the furnace when the block is in place. Again, the angle of upper face 48 of block 23 will be such that, when assembled with block 21, upper face 48 is parallel to the horizontal surfaces 25 of lining brick 24. Also, side faces 49R and 49L of block 23 will be tapered inward in the same manner as are blocks 21 and 22.

It is not essential that side surfaces 42 and 43 of block 22 and side surfaces 49R and L of block 23 be tapered, although this makes for a much tighter, and therefore better, refractory structure, as well as allowing proper "keying" of the blocks to the surrounding lining. However, in any case the planes of these sides will lie within the planes extended of side faces 37 and 38 of block 21.

It is essential that block 23 be keyed or interlocked into block 21 since otherwise it would tend to slide into the furnace, allowing brick 24 above it also to fall. While this keying can be done by any suitable means, it is most conveniently done by forming holes or slots 34 and 36 in blocks 21 and 23, respectively, of a size and shape such as to receive a standard $9\times4\frac{1}{2}\times2\frac{1}{4}$ inch ($228\times114\times57$ mm) refractory brick.

Cut edges 50, 51, and 52 of blocks 21, 22, and 23, respectively, are to avoid the presence of acute angle edges on the refractories, edges which tend to break and crumble leaving a rough surface. In addition, cut edge 50 allows block 21 to rest directly on a brick 24 of the working lining, thus reducing, the risk of slipping.

To assemble the present taphole in a furnace lining, block 21 can be placed on a balance bar 53 with counterweight 54. Block 21 is retained on bar 53 by removable retainer plate 56 which is retained on bar 53 by any convenient retainer 57, for example a bolt. Bar 53 is supported by vertical member 58 which can be attached to a crane or other lifting device (not shown). Block 21 is suspended in place at the correct angle as the furnace lining is laid up and held at that angle until it is firmly embedded in the surrounding lining. When brick 24 reach the lower edge of block 21, lower wedge block 22 is put in position. Then block 21 is placed over block 22 and held in its correct orientation by balance bar 53. Lining brick 24 are then laid up beside blocks 21 and 22, completing the lining up to the top of block 21. Upper wedge block 23 is then placed in position and further bricking of lining 24 continued to lock the entire taphole assembly in place. After this, further lining brick 24 can be laid to complete the lining. After the taphole assembly is in place and the lining completed, suspending bar 53 is removed and retaining plate 33 attached to shell 26 by any convenient means (not shown), for example by welding.

It will be evident that a modified version of the taphole of this invention can also be used as a replacement taphole without the necessity for completely relining the furnace.

We claim:

1. Taphole assembly adapted for use in a furnace, said assembly comprising: (1) a monolithic central block having an upper face, a lower face, two opposing side faces, an inner end face and an outer end face, the two side faces converging toward the inner end face, said block having a passageway adapted to carry flowing molten metal and extending from the inner end face to the outer end face; (2) a bottom wedge block having a lower face, an upper face, an outer face, and two opposed side faces; and (3) a top wedge block having a lower face, an upper face, an inner face, and two opposed side faces; the configuration of both upper and lower wedge blocks being such that, when assembled with the upper face of the bottom block against the bottom face of the central block, and the lower face of the top block against the upper face of the central block, the lower face of the bottom wedge block is parallel to the upper face of the top wedge block, the side faces of each wedge block lying within the planes formed by extension of the side faces of the central block; the top and central blocks being keyed together to prevent relative movement parallel to their contacting faces.

2. Assembly according to claim 1 wherein the upper and lower faces of the central block converge toward the hot face end.

3. Assembly according to claim 1 wherein the side faces of each wedge block form extensions of the side faces of the central block.

4. Assembly according to claim 1 wherein the upper and lower faces of the central block converge toward the hot face, and the side faces of each wedge block form extensions of the side faces of the central block.

5. Assembly according to claim 1, 2, 3 or 4 wherein the hot face end of the central block forms an acute angle with the bottom face and an obtuse angle with the top face of the block.

6. Method of installing the assembly of claim 1 in a furnace, said method comprising (1) placing the central block on a counterweighted bar supported outside the furnace;

(2) placing the central block on the bar in position in the furnace;

(3) placing the bottom wedge block in position below the central block; and (4) placing the upper block in position above the central block.

* * * * *